United States Patent [19]

Marshall et al.

[11] 4,363,203

[45] Dec. 14, 1982

[54] LIQUID FILL APPARATUS

[75] Inventors: Steven Marshall, Glen Waverley; Vincent Papaluca, Camberwell, both of Australia

[73] Assignee: ACI Operations Pty. Ltd., Melbourne, Australia

[21] Appl. No.: 179,466

[22] Filed: Aug. 19, 1980

[30] Foreign Application Priority Data

Aug. 20, 1979 [AU] Australia ..... PE0093

[51] Int. Cl.[3] ..... B65B 31/06; B67B 1/00; B65B 7/28

[52] U.S. Cl. ..... 53/109; 53/168; 53/281; 53/381 A

[58] Field of Search ..... 53/381 A, 202, 109, 53/283, 281, 319, 300, 168; 81/3.2, 3.3 R, 3.31, 3.32, 3.44; 141/114, 313, 372, 378, 387

[56] References Cited

U.S. PATENT DOCUMENTS

| | | | |
|---|---|---|---|
| 326,630 | 9/1885 | Codd | 81/3.31 |
| 3,377,775 | 4/1968 | Mattimoe et al. | 53/381 A |
| 3,447,281 | 6/1969 | Buford et al. | 53/381 A X |
| 3,516,220 | 6/1970 | Buford et al. | 141/313 X |
| 4,077,182 | 3/1978 | Papaluca | 53/381 A |
| 4,120,134 | 10/1978 | Scholle | 141/313 X |
| 4,235,132 | 11/1980 | Kendall | 81/3.44 |
| 4,250,691 | 2/1981 | Marshall | 53/381 A X |

FOREIGN PATENT DOCUMENTS

| | | | |
|---|---|---|---|
| 412181 | 6/1934 | United Kingdom | 141/372 |

*Primary Examiner*—Horace M. Culver
*Attorney, Agent, or Firm*—Murray and Whisenhunt

[57] ABSTRACT

An apparatus for filling a flexible container has a filling head and a pair of closure removing heads so that while the one container is being filled a filled container is closed and another prepared for filling.

6 Claims, 5 Drawing Figures

LIQUID FILL APPARATUS

This invention relates to an apparatus for filling containers with liquid and more particularly to an apparatus for filling flexible, collapsible containers or receptacles in the form of plastic pouches having a filling and pouring spout secured to the pouch in communication with an access opening of the pouch. Such containers are suitable for packaging wines which should be stored in oxygen free conditions to avoid contamination. The filled pouch is usually accommodated in a paperboard carbon.

An example of a spout/closure system which is suitable for use with the apparatus of the invention is the Fattori system described in Australian Pat. No. 446,218. It will be appreciated however that the apparatus of the invention is applicable also to other types of closures.

In order to fill a pouch of the above kind, it is necessary to perform the operations of removing a closure member from the spout, filling the pouch with the liquid to be packaged, and in the case of oxidisable fluids such as non-fortified wines, purging oxygen and other contaminants from the pouch and replacing the closure member on the spout. In view of the flexibility of the pouch, it becomes difficult to handle once filled and therefore it is desirable to reduce the number of handling operations to a minimum.

U.S. Pat. No. 4,077,182 describes an apparatus in which the operator places the spout of a flexible pouch between a fixed fork after which a closure removal head removes the closure from the spout. The closure removal head then advances to another position clear of the spout whilst a filling head simultaneously is brought into filling engagement therewith. After completion of the filling cycle the filling head returns to its original position whilst the closure removal head simultaneously replaces the closure on the spout. The operator removes the filled package from the fork and replaces it with an empty one to complete the cycle of operations.

Whilst the aforesaid apparatus effectively fills flexible packages, its speed is limited.

The present invention has as an object to provide an apparatus that is capable of filling such packages at greater speed.

Accordingly the present invention provides an apparatus for liquid filling flexible, collapsible containers, said containers having a pouring spout and a closure for said spout, said apparatus comprising:

a left holding means and a right holding means each for holding a separate spout during the steps of closure removal, filling of the container with liquid, and closure replacement on said spout;

a left closure removal means and a right closure removal means each for gripping and removing said closures and for replacing same;

a fill head having nozzle means for passing liquid into said container through said spout; and frame means having said fill head mounted thereon between said left closure removal means and said right closure removal means, said frame means being moveable between (i) a left position where said fill head is adjacent said left holding means and said right closure removal means is adjacent said right holding means and (ii) a right position where said fill head is adjacent said right holding means and said left closure removal means is adjacent said left holding means;

said apparatus being arranged for a sequence of operations where (i) with said frame in its right position said fill head cooperates with a spout held in said right holding means to fill the associated container with liquid, whilst said left closure removal means replaces a closure on a spout held in said left holding means, said left holding means releases said spout, a further container is moved into position adjacent said left holding means, the spout of which is gripped thereby, and said left closure removal means removes the closure therefrom and (ii) said frame is moved to its left position where said fill head cooperates with the spout held in said left holding means to fill the associated container with liquid, whilst said right closure removal means replaces a closure on the spout held in said right holding means, said right holding means releases said spout, a further container is moved into position adjacent said right holding means the spout of which is gripped thereby and said right closure removal means removes the closure therefrom, and so on.

Preferred embodiments of the invention will now be described with reference to the accompanying drawings wherein.

Figure 1:
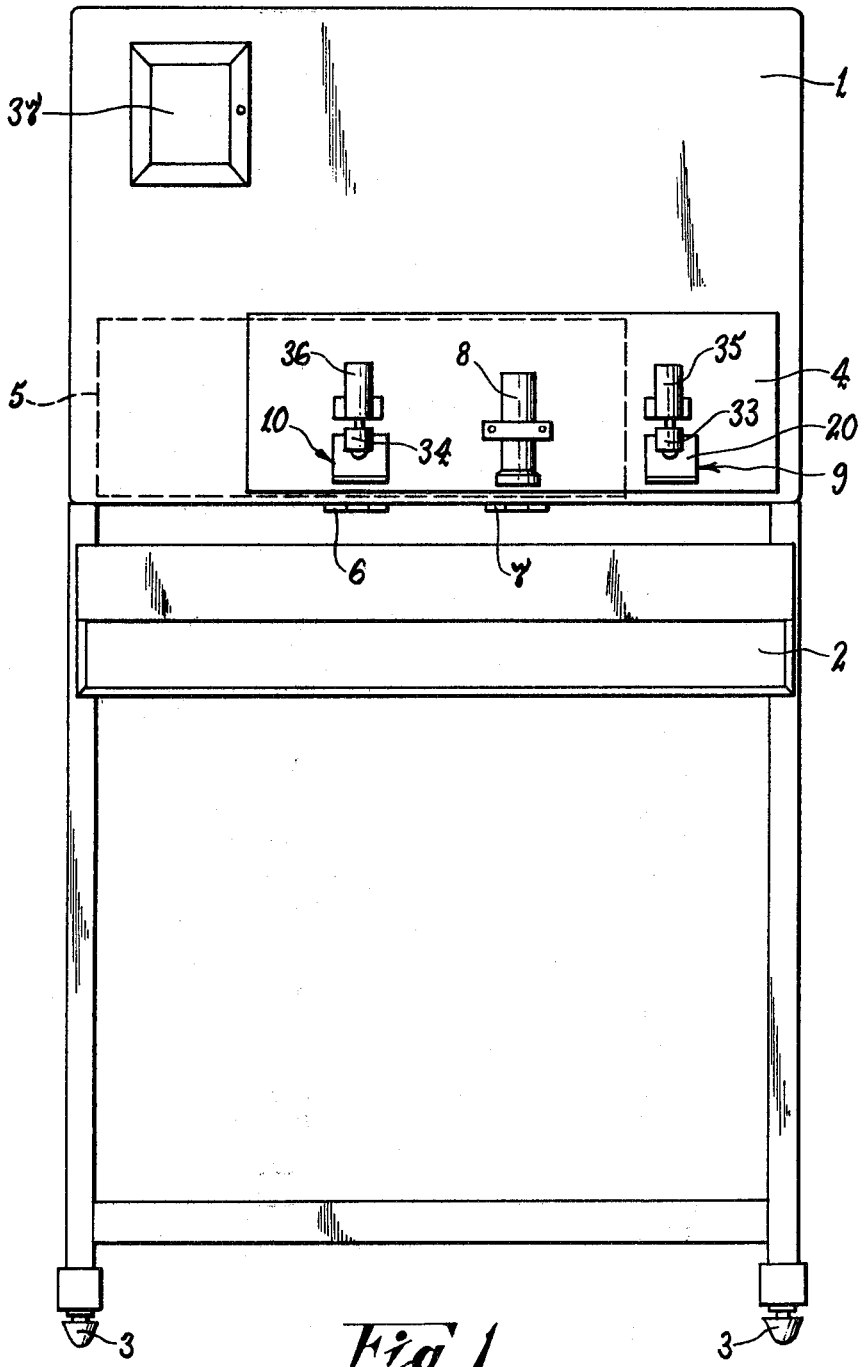
FIG. 1 is a front elevation of one form of apparatus in accordance with the invention.
Figure 2:
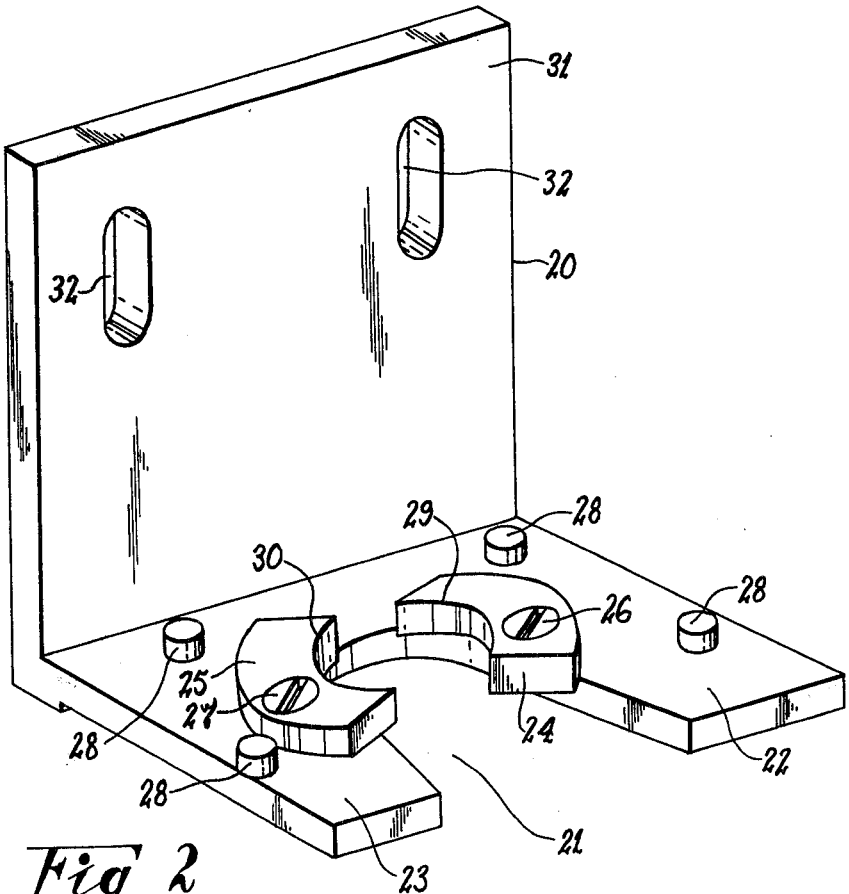
FIG. 2 is a perspective of part of the removal mechanism used on the apparatus of FIG. 1.
Figure 4:
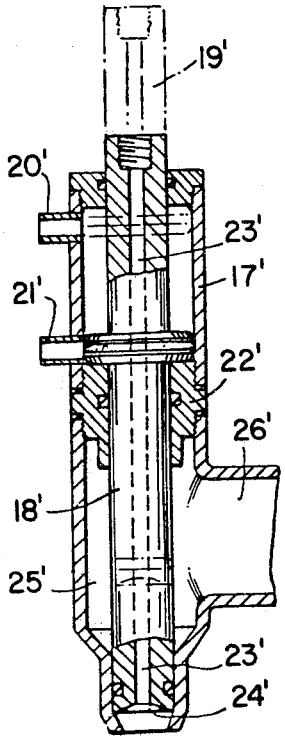
FIG. 4 is a sectional front elevation of the fill head of the apparatus of FIG. 1.
Figure 5:
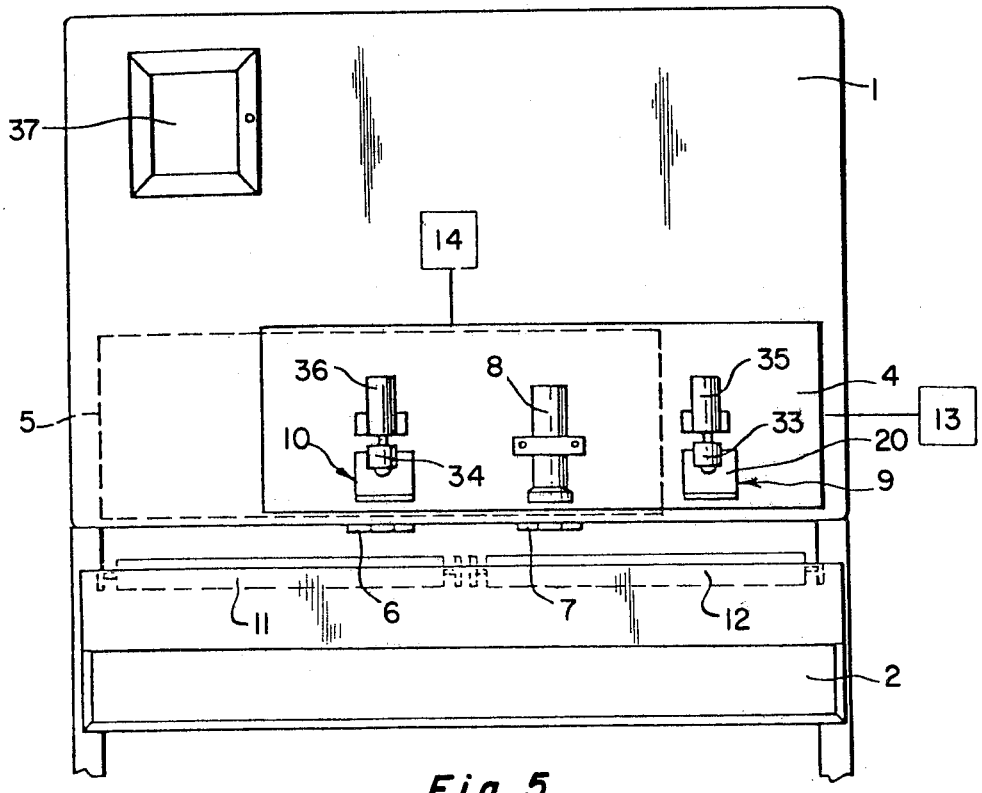
FIG. 5 is a front elevation of the apparatus of FIG. 1 illustrating the conveyor means and pneumatic means thereon.

Referring to FIGS. 1 and 2, the apparatus includes a cabinet 1 mounted on a stand 2 which is provided with legs having an adjustment foot 3. The cabinet holds the mechanical and electrical componentry associated with the movement and operation of the filling and closure removal heads.

The apparatus according to the invention includes a left holding means and a right holding means each for holding a separate spout during the steps of closure removal, filling of the container with liquid and closure replacement on the spout. The left holding means may be provided by forked fingers 6 and the right holding means by forked fingers 7. The forked fingers 6 and 7 are so spaced as to cooperate with a groove on the preferred form of spout as is known in the art.

The apparatus of the invention also includes a left closure removal means and a right closure removal means each for gripping and removing the closures and for replacing them. Preferably the gripping is by a pinching action. Preferably the left closure removal means is provided by a closure removal head shown generally at 10 and the right closure removal means is provided by a closure removal head shown generally at 9. Preferably each closure removal head 9 and 10 includes a piston or plunger 33 and 34 respectively which are moved by pneumatic cylinders 35 and 36. The heads 9 and 10 are adapted to pinch or grip the closure to remove it and replace it as required.

The apparatus of the present invention also includes a fill head shown generally at 8 having nozzle means for passing liquid into the container through the spout. A preferred form of fill head and nozzle is fully described in U.S. Pat. No. 4,077,182, with the described fill head including a description of apparatus for subjecting the interior of the containers to a vacuum through the spout, passing liquid through the spout and passing a purging stream of inert gas into the container through the spout. Preferably the fill head is designed to evacuate each container fill it with a metered quantity of liquid such as wine and finally flush the filled pouch with an inert gas such as nitrogen which is adapted to prevent deterioration of the contents of the container through contact with oxygen.

A frame means is provided for mounting the fill head between the left closure removal means and the right closure removal means. A suitable form of frame means, as illustrated in FIG. 1, is provided by a mounting plate 4 mounted in front of the cabinet by driven supports (not shown) which extend thereinto and an appropriate arrangement of mechanical devices, such as horizontally and vertically acting pneumatic cylinders (not shown) mounted behind the mounting plate 4 to move it back and forth between two positions shown respectively by the full lines and the broken lines 5.

Both of the closure removal/replacement heads 9 and 10 are most suitably constructed in the same way. They may include a closure removal bracket along the lines of the bracket shown in FIG. 2 and generally designated by the reference numeral 20. The bracket 20 has a wedge shaped opening 21 defined by the bracket arms 22 and 23 into which a spout with a closure mounted thereon may be pushed by an operator. Two crescent shaped segments 24 and 25 are pivotally mounted on the arms 22 and 23 about the end of the opening 21 by the screw pin members 26 and 27. A number of stop pins 28 are provided on the arms 22 and 23 to limit the extent to which the segments 24 and 25 may move. The underneath of each of the segments is provided with a spring loaded ball mechanism (not shown) which interacts with a groove provided on each arm underneath each segment to "click" the segments into a hold open position when a spout and closure are removed therefrom. When a spout and closure are pushed into the opening 21 the two segments "click" out of their open position and take up the configuration illustrated in FIG. 2. The inner edges 29 and 30 are thereby arranged to fit beneath the skirt of the closure so that it can be lifted off.

The vertical section 31 of the bracket 20 may be provided with means to attach same to the closure removal/replacement heads. Bolt holes 32 which allow the brackets to be secured by bolts to the lower parts of the closure removal/replacement heads illustrated in FIG. 1 are generally adequate for this purpose.

An electronic console 37 is provided on the front of the cabinet for controlling the various parameters relating to the filling cycle of the apparatus. A typical sequence of operations which may be controlled by the console settings is listed hereinbelow:

(i) An operator places the spout of an unfilled pouch in the fork 6 and the apparatus is started.

(ii) The plunger 34 comes down on the closure mounted on the spout and rigidly holds it in contact with the edges 29 and 30 of the segments 24 and 25.

(iii) The plate 4 lifts vertically, travels horizontally and then descends to the position 5 illustrated in broken lines, thereby removing the closure from the spout, positioning the fill head above the now open spout and positioning the closure removal/replacement head 9 above the fork 7.

(iv) The operator places the spout of an unfilled pouch in fork 7 whilst the fill head evacuates, fills and flushes the pouch held by fork 6.

(v) The plunger 33 descends to secure the closure mounted on the spout held in fork 7.

(vi) The plate 4 lifts vertically, travels horizontally and then descends to the position illustrated in full in the drawing, thereby removing the closure from the spout held in fork 7, positioning the fill head above the spout held in fork 7, replacing the closure on the spout of the filled pouch held by fork 6 and positioning the fill head 8 above the now open spout held in fork 7.

(vii) The plunger 34 is retracted and the operator removes the filled closured pouch from the fork 6 and replaces it with an empty one. Alternatively the apparatus may include a pneumatic piston which automatically pushes the closured pouch from the fork.

(viii) The cycle is repeated indefinitely.

Figure 3:
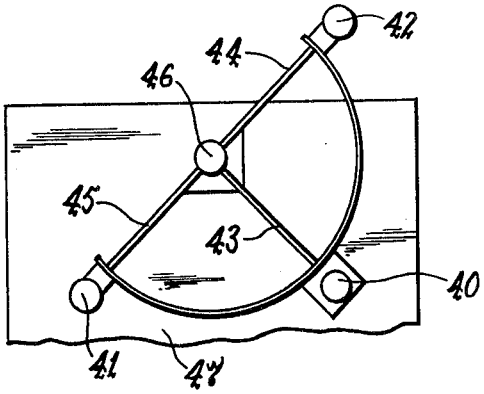
FIG. 3 is a plan view of an alternative fill head/closure removal head apparatus according to an embodiment of the invention.

Referring to FIG. 3, the apparatus shown therein resembles that described with reference to FIGS. 1 and 2 in a large number of respects. The apparatus is provided with one filling head 40 and two closure removal/replacement heads 41 and 42, all three heads being constructed as described with reference to FIGS. 1 and 2. These three heads are mounted via three radial arms 43, 44 and 45 respectively on a vertically extending post 6 which holds the assembly of arms and heads above a horizontal table surface 47. Means are provided beneath the table to raise and lower the post 46 and to cause it to rotate between the configuration illustrated in the drawing to a position 90 degrees advanced from the illustrated configuration moving in a clockwise direction. Thus the closure removal/replacement head 42 may be moved from the illustrated position to a position coinciding with the illustrated position of the fill head 40 and the fill head 40 takes the position of closure removal/replacement head 41. A fork (not illustrated) for holding the spout of a pouch is mounted underneath the illustrated position of the filling head 40 and of the closure removal/replacement head 41.

The operating sequence described with reference to FIGS. 1 and 2 may be applied to the apparatus of FIG. 3, the only substantive difference being the method of moving the heads between their operating positions. During a normal cycle, the post 46 will be raised, twisted 90 degrees and lowered to its original height, after which the sequence is reversed to bring it back to its original position, thereby giving an equivalent movement of the various heads to that provided by the plate 4 in FIG. 1.

It will be appreciated then that the present invention provides an apparatus in which whilst one bag is being filled a bag on an adjacent conveyor is being closed off and then a fresh bag moved into position and the closure removed ready for filling. In this way there is a significant increase in the speed of the machine as compared with the arrangement of the prior art above described. By the use of the conveyor system and filling apparatus of the present invention one is able to employ a web of container bags that are severed only after filling. This enables the machine to operate continuously and without the need for direct manual involvement. Of course it will be appreciated that many variations and alterations may be made to the above described construction and arrangement of parts without departing from the ambit of the present invention as defined in the claims annexed hereto.

We claim:

1. Apparatus for liquid filling flexible, collapsible containers, said containers having a pouring spout and a closure for said spout, said apparatus comprising:

a left holding means and a right holding means each for holding a separate spout during the steps of closure removal, filling of the container with liquid, and closure replacement on said spout;

a left closure removal means and a right closure removal means each for gripping and removing said closures and for replacing same;

a fill head having nozzle means for passing liquid into said container through said spout; and frame means having said fill head mounted thereon between said left closure removal means and said right closure removal means, said frame means being moveable between (i) a left position where said fill head is adjacent said left holding means and said right closure removal means is adjacent said right holding means and (ii) a right position where said fill head is adjacent said right holding means and said left closure removal means is adjacent said left holding means;

said apparatus being arranged for a sequence of operations where (i) with said frame in its right position said fill head cooperates with a spout held in said right holding means to fill the associated container with liquid, whilst said left closure removal means replaces a closure on a spout held in said left holding means, said left holding means releases said spout, a further container is moved into position adjacent said left holding means, the spout of which is gripped thereby, and said left closure removal means removes the closure therefrom and (ii) said frame is moved to its left position where said fill head cooperates with the spout held in said left holding means to fill the associated container with liquid, whilst said right closure removal means replaces a closure on the spout held in said right holding means, said right holding means releases said spout, a further container is moved into position adjacent said right holding means the spout of which is gripped thereby and said right closure removal means removes the closure therefrom, and so on, wherein a container held in the left holding means is filled by the same fill head nozzle means as a container held in the right holding means.

2. Apparatus as claimed in claim 1, wherein said frame means is adapted for movement in a plane between said left and right positions.

3. Apparatus as claimed in claim 1, wherein said frame means is adapted for rotation between said left and right positions.

4. Apparatus as claimed in claims 1, 2 or 3, including conveying means to support said containers and to convey them in a pair of rows to said respective spout holding means.

5. Apparatus as claimed in claim 1, wherein said fill head includes means for subjecting the interior of the containers to a vacuum through the spout, passing liquid into the container through the spout and passing a purging stream of inert gas into the container through the spout.

6. Apparatus as claimed in claim 1, including pneumatic means to move said frame means between its left and right positions and also to operate said closure removal means and said holding means.

* * * * *